United States Patent [19]

Paton et al.

[11] 3,990,500

[45] Nov. 9, 1976

[54] APPARATUS WITH CORE FOR MAKING HOLLOW INGOTS BY ELECTROSLAG REMELTING

[76] Inventors: Boris Evgenievich Paton, ulitsa Kotsjubinskogo, 9, kv. 21; Boris Izrailevich Medovar, bulvar Lesi Ukrainki, 2, kv. 8; Jury Vadimovich Latash, Vozdukhofletsky prospekt, 81, kv. 14; Leonty Vasilievich Chekotilo, ulitsa Scherbakova 49-a, kv. 10; Vitaly Mikhailovich Baglai, ulitsa Semashko, 10, kv. 54/3; Viktor Leonidovich Artamonov, ulitsa Sevetskaya, 9, kv. 4; Rodimir Ivanovich Garkaljuk, ulitsa Bolshaya Kitaevskaya, 142, korpus 14, kv. 33; Viktor Anatolievich Timchenko, ulitsa Vladimirskaya, 98/3, kv. 36; Evgeny Fedorovich Malichenko, prospekt Entuziastov, 7/2, kv. 161; Leonid Mikhailovich Stupak, Brestlitovsky prospekt, 39, kv. 9; Rudolf Solomonovich Dubinsky, Brestlitovsky prospekt, 4, kv. 15, all of, Kiev, U.S.S.R.

[22] Filed: Jan. 17, 1975

[21] Appl. No.: 541,712

Related U.S. Application Data

[60] Continuation of Ser. No. 341,921, March 16, 1973, abandoned, which is a division of Ser. No. 124,836, March 16, 1971, abandoned, which is a division of Ser. No. 771,165, Oct. 28, 1968, abandoned.

[52] U.S. Cl. ..... 164/252

[51] Int. Cl.[2] ..... B22D 27/02

[58] Field of Search ..... 164/52, 85, 136, 252, 164/344, 345

[56] References Cited

UNITED STATES PATENTS

| | | | |
|---|---|---|---|
| 2,369,233 | 2/1945 | Hopkins | 164/52 |
| 2,380,238 | 7/1945 | Hopkins | 164/52 X |
| 2,405,254 | 8/1946 | Hopkins | 164/252 X |
| 2,941,266 | 6/1960 | Ostermeyer et al. | 164/85 |
| 3,409,068 | 11/1968 | Yearley et al. | 164/85 |
| 3,670,089 | 6/1972 | Paton et al. | 164/52 X |

FOREIGN PATENTS OR APPLICATIONS

| | | | |
|---|---|---|---|
| 689,297 | 1/1967 | Belgium | 164/252 |
| 1,103,350 | 2/1968 | United Kingdom | 164/52 |

*Primary Examiner*—Francis S. Husar
*Assistant Examiner*—John E. Roethel
*Attorney, Agent, or Firm*—Strauch, Nolan, Neale, Nies & Kurz

[57] ABSTRACT

Apparatus for electroslag remelting of at least one consumable electrode in a cooled mold assembly with a cooled bottom plate having mechanism accomplishing relative movement between at least a part of the mold assembly and the ingot being formed during forming of the ingot. Movement of selective parts of the mold assembly relative to the ingot and/or the electrode is provided with or without movement of the electrode itself. Structure for bottom pouring of molten slag is provided. A specific mold assembly has, as an element, a cooled core device enabling making hollow ingots, in which case the hollow core device can be moved axially, reciprocated axially and reciprocally rotated during forming of the ingot. Electrical power for the electroslag remelting can be connected between the consumable electrode and any or all elements of the mold assembly.

44 Claims, 3 Drawing Figures

APPARATUS WITH CORE FOR MAKING HOLLOW INGOTS BY ELECTROSLAG REMELTING

CROSS-REFERENCE TO RELATED APPLICATIONS

This application is a continuation of application Ser. No. 341,921, filed Mar. 16, 1973 now abandoned, which is a division of application Ser. No. 124,836, filed Mar. 16, 1971 now abandoned as a division of our then co-pending application Ser. No. 771,165, for METHOD OF OBTAINING METAL HOLLOW INGOTS BY ELECTROSLAG REMELTING AND DEVICE FOR EFFECTING SAME, filed Oct. 28, 1968, now abandoned, and replaced by continuation application Ser. No. 129,168, which issued as U.S. Pat. No. 3,721,286, entitled METHOD OF OBTAINING METAL HOLLOW INGOTS BY THE ELECTROSLAG REMELTING.

BACKGROUND OF THE INVENTION

The present invention relates to methods for obtaining metal hollow ingots by electroslag remelting, and to devices for effecting same. The invention may be made use of for obtaining hollow ingots of pipe stock from steels, alloys and metals (ball-bearing, highly alloyed, heat-resistant, anticorrosive, high-strength structural, and the like including those difficult to work), intended for subsequently processing into pipes and other articles by pressing, rolling out, rolling, etc.

Known in the prior art is a method for obtaining hollow metal ingots by the electroslag remelting of a hollow (in the tubular form) consumable electrode in a cooled annular ingot mold composed of a cooled mold and a cooled bottom plate together with a cooled core being made stationary in relation therewith.

In this case, a consumable electrode is remelted in an annular gap between the mold and core. During the entire remelting process of a hollow ingot, the slag bath is given an annular form. Its cross section is almost equal to that of a hollow ingot to be made.

A disadvantage of the prior-art method consists first of all in that for making ingots there are employed expensive hollow (in the tubular form) consumable electrodes. Moreover, the hollow ingot to be built-up squeezes the core during shrinkage, which may cause cracking in the ingot, and as a result the core will have to be removed from each ingot by mechanical means.

A primary object of the present invention is to provide such apparatus using electroslag remelting to make ingots, particularly hollow ingots, which would permit using cheap consumable electrodes of a solid section (both deformed or cast), precluding the formation of cracks in the ingot making ingots, particularly hollow ingots possessing a good internal surface, to be directly used for further processing.

In conformity with these and other objects of the invention, the proposed device or apparatus for making hollow ingots by the electroslag remelting of a consumable electrode in a cooled mold having a core disposed therein, the core forming the internal cavity of the ingot being built up on a cooled bottom plate, features, according to the invention, a mold, a core and a bottom plate together with an ingot secured thereon in the process of remelting the consumable electrode, which are given longitudinal motion in relation to each other so that the upper end face of the core is constantly immersed in the molten slag bath.

The mutual motion of the mold, core and bottom plate may be carried into effect either by moving the cooled core upwardly in relation to the stationary mold and bottom plate, or by moving the bottom plate together with the ingot secured thereon downwardly in relation to the core and stationary mold, or, finaly, by moving the mold together with the bottom plate and the ingot secured thereon and being built-up downwardly in relation to the core.

To improve the internal surface of the hollow ingot being made, the core during the remelting process should be given rocking motion.

The device for carrying into effect the proposed method, comprising a cooled mold, a bottom plate and a core for shaping a cavity in the ingot being built-up, according to the invention, is provided with mechanisms for effecting mutual motion of the mold, bottom plate and core in the process of remelting a consumable electrode.

The device is preferably provided with a mechanism for imparting to the cooled core a rocking motion in a longitudinal direction, and a mechanism for imparting to the core reciprocal rotary motion.

The nature of the present invention will further be made more fully apparent from a consideration of the following description of its exemplary embodiments, taken in conjunction with the accompanying drawings.

BRIEF DESCRIPTION OF DRAWINGS

Preferred structural embodiments of this invention are disclosed in the accompanying drawings in which.

Figure 2:
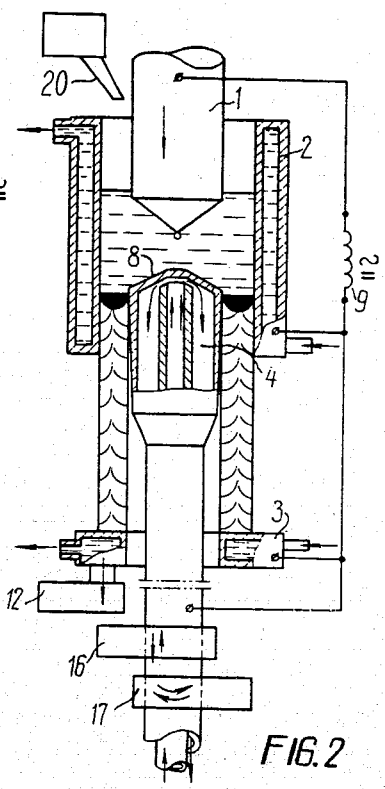
FIG. 2 shows the same device complete with a mechanism for moving a bottom plate together with an ingot in relation to the core and stationary mold.
Figure 1:
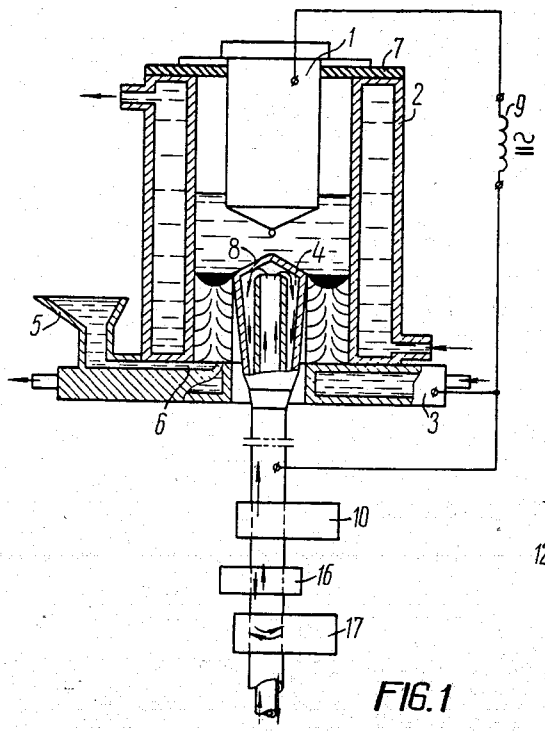
FIG. 1 represents a device for obtaining hollow ingots by the electroslag remelting of a consumable electrode, which, according to the invention, is provided with a mechanism for moving a core in relation to a stationary mold and bottom plate.

The remelting of the consumable electrode 1 (FIGS. 1, 2, 3) is carried out in a cooled mold 2. Provided under the mold is a cooled bottom plate 3 provided with an opening.

The internal surface of the hollow ingot being built-up is formed by means of a cooled rod 4 passing through the opening in the bottom plate. A bottom-pouring device 5 and a runner 6 are provided in order to supply the molten slag into the mold. Slag may be also top-poured into the mold, as by a feed device 20, in a manner well known in the art. During the remelting process, a consumable electrode 1 is fed into the slag bath. The process of remelting a hollow ingot, however, may be also carried into effect with the consumable electrode being stationary. In this case, the electrode is secured on the upper edge of the mold, being insulated therefrom by means of a packing 7, whereas the cross-sectional area of the electrode will have to be selected equal or approximating that of the hollow ingot being made in the remelting process.

Before starting the remelting process, the rod 4 is inserted in the opening of the bottom plate in such a manner that the upper end face thereof be projected over the bottom plate and will form together with the mold an annular gap. The gap between the core and opening in the bottom plate must be as small as possible in order to prevent slag from flowing out from the mold at the beginning of the remelting process. The molten slag is poured into the mold, thus forming the slag bath. Then voltage from an alternating or direct-current source such as the power source 9 is applied to the electrode 1, the bottom plate 3 and the core 4.

With the voltage applied, as soon as the lower end of the consumable electrode and the molten slag bath are in contact, current starts to flow and melting of the consumable electrode begins. The melting of the consumable electrode results in molten metal, which gets into the annular gap, thus flowing around the upper end face 8 of the cooled core 4 projecting into the slag bath. This brings about the formation of a molten annular metal bath, from which a hollow ingot solidifies. In the remelting process, the upper end face of the cooled core will have to be maintained in the slag bath so as to prevent a solidifed crust from being formed thereon, which may interfere with the further proceeding of the remelting process.

For constantly maintaining the upper end face 8 of the core in the slag bath in the process of building up the hollow ingot, there is carried into effect the mutual movement of the mold, core and bottom plate together with the ingot being built-up and secured thereon, at a speed near that of rising of the slag bath.

Figure 3:
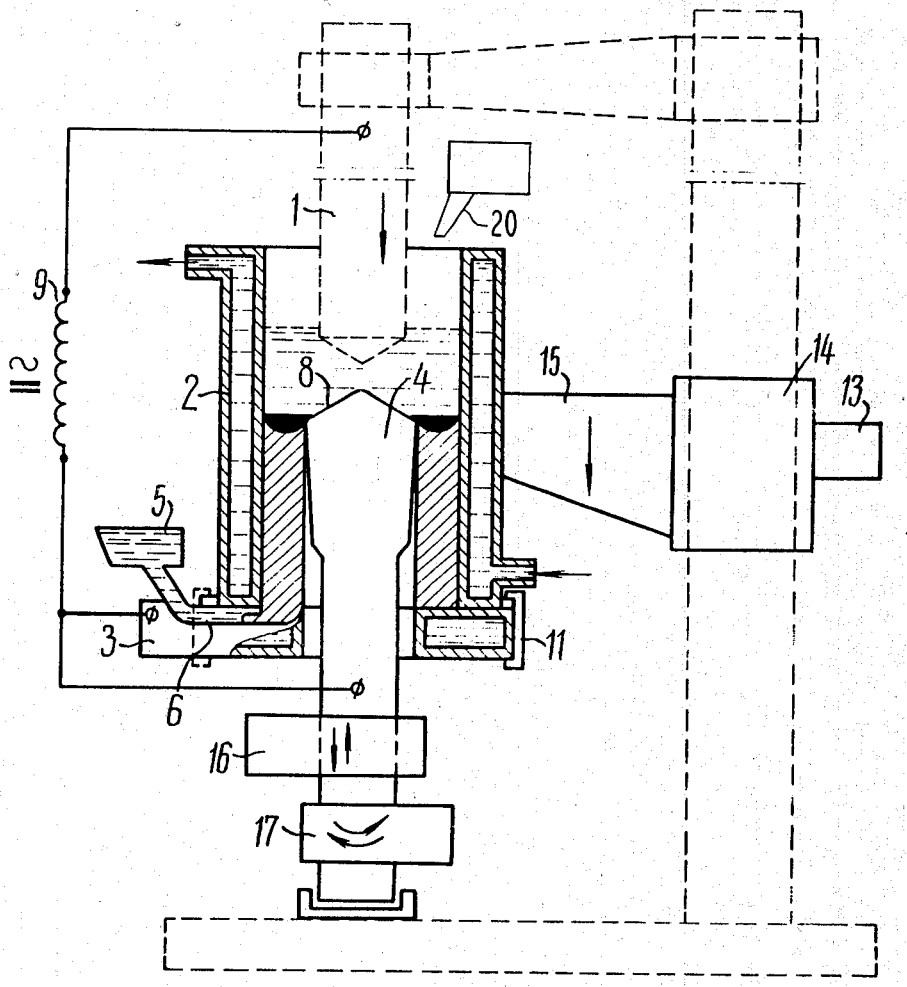
FIG. 3 represents the same device complete with a mechanism for moving the mold together with the bottom plate and the ingot being built-up downwardly in relation to the core.

Motion of the core upwardly in relation to the stationary mold and bottom plate is carried into effect by means of a mechanism 10 (FIG. 1) provided on the rod of the core. In this case, the mold is stationary and is secured on the bottom plate, for example, by means of a screw clamp 11 (FIG. 3). Pick-ups (which are not shown in the drawing) are employed for controlling the position of the upper end of the core in the slag bath.

In conformity with the second embodiment of the invention, the internal cavity of the ingot is formed by moving the bottom plate together with the ingot in relation to the core and stationary mold by having recourse to a mechanism 12 (FIG. 2) connected to the bottom plate (for example, a screw pair).

FIG. 3 represents a device for casting a hollow ingot, in which, in the process of its remelting, the mold is moved in relation to the core together with the bottom plate and the ingot secured thereon. A mechanism 13 (FIG. 3) is connected with the mold through a support 14 and a bracket 15. In this case, the mold is secured on the bottom plate by means, for example, of screw clamps 11.

To improve the internal surface of the hollow ingot the core may be connected to a mechanism 16, imparting thereto rocking motion in the longitudinal direction and/or to a mechanism 17 imparting thereto reciprocal rotary motion.

As soon as the hollow ingot of the required length is made, the voltage is disconnected and the consumable electrode is removed. In all the above-mentioned embodiments of the device, disconnection of voltage is followed by the mutual motion of the mold, core and bottom plate together with the ingot secured thereon until the core completely emerges from the ingot's cavity so as to prevent the core from being clamped in the ingot during its shrinkage in cooling.

Thereafter, the core is disengaged from its rod, and the hollow ingot is extracted.

The proposed method and device for effecting same permit hollow ingots to be produced without internal, nor external defects, from a high-quality, electroslag metal. Application of this method and device for effecting same permit elimination of expensive operations, such as drilling and piercing, when manufacturing pipe stock from cores of solid section which is of a special importance when manufacturing pipe stock from metals and alloys that are difficult to work.

The invention may be embodied in other specific forms without departing from the scope, spirit, or essential characteristics thereof. Present embodiments are, therefore, to be considered in all respects as illustrative and not restrictive, the scope and spirit of the invention being indicated by the appended claims rather than by the foregoing description and all changes which come within the meaning and range of equivalency of the claims are, therefore, intended to be embraced therein.

What is claimed and desired to be secured by Letters Patent is:

1. A device for manufacturing a hollow metal ingot by electroslag melting from consumable metal electrode means comprising: a mold for retaining a molten slag bath; a bottom plate for supporting said metal ingot; a core member having a free upper end adapted to move within said mold to form the internal cavity of said hollow ingot; means including said electrode means for forming a molten metal pool below said molten slag bath; and means for providing relative movement, at least in an axial direction, between said core member and said bottom plate, in such a manner that at least a portion of the upper end face of said core member is maintained in contact with said molten slag bath during formation of said hollow ingot.

2. A device as defined by claim 1, wherein both of said mold and said core member include means for fluid cooling.

3. A device as defined by claim 1, including means for bottom pouring molten slag into said mold.

4. A device as defined by claim 3, also including means enabling top-pouring of slag into the mold.

5. A device as defined by claim 1, including means to move said mold relative to said bottom plate.

6. A device as defined by claim 5, wherein said means to move said mold is adaptable to hold said bottom plate in fixed position and to move said mold relative to said bottom plate in a direction upwardly therefrom.

7. A device as defined by claim 5, including means adaptable to hold said mold in fixed position and to move said bottom plate axially away therefrom.

8. A device as defined by claim 1, wherein said means for forming said molten metal pool includes means maintaining said consumable metal electrode means in contact with said molten slag bath.

9. A device as defined by claim 8, including means for moving said mold along its axis during the formation of said hollow ingot.

10. A device as defined by claim 8, including means to move said consumable electrode means axially into said molten slag bath during melting of the electrode.

11. A device as defined by claim 10, including means of moving said mold along its axis during the formation of said hollow ingot; said means for moving said mold being adaptable to control the movement of said mold in the same axial direction as movement of said consumable electrode means.

12. A device as defined by claim 8, including a source of electric power connected to said consumable metal electrode means, said mold, and said core member.

13. A device as defined by claim 12, wherein said source of electric power has its output connected to said core member and said bottom plate from a common potential point therein.

14. A device as defined by claim 12, wherein said source of electric power has an A.C. output.

15. A device as defined by claim 12, wherein said source of electric power has a D. C. output.

16. A device as defined by claim 1, including means to axially reciprocate said core member within said hollow ingot during its formation.

17. A device as defined by claim 1, including means to reciprocally rotate said core member within said hollow ingot during its formation.

18. A device as defined by claim 1, wherein said core member is axially aligned within said mold.

19. A device as defined by claim 1, including means to maintain said core member in fixed position and to move said bottom plate relative thereto.

20. A device as defined by claim 1, including means to maintain said bottom plate in fixed position and to move said core member axially relative thereto.

21. A device as defined by claim 20, wherein said means to maintain said bottom plate in fixed position and to move said core member is adaptable to maintain said mold in fixed position and in contact with said bottom plate during formation of said hollow ingot.

22. A device as defined by claim 1, including a consumable metal electrode, and means for maintaining said metal electrode in contact with said molten slag bath within said mold.

23. A device as defined by claim 22, wherein said means for maintaining said metal electrode in contact with said slag bath is adaptable to move said consumable electrode into said molten slag bath during formation of said hollow ingot.

24. A device as defined by claim 22, wherein said means for maintaining said metal electrode in contact with said slag bath is adaptable to hold said consumable metal electrode in fixed position relative to said bottom plate.

25. A device as defined by claim 24, wherein said means for maintaining said metal electrode in contact with said slag bath is adaptable to maintain said mold in fixed position and to move said core member relative to said mold.

26. A device as defined by claim 1, including means to axially reciprocate and to simultaneously reciprocally rotate said core member within said hollow ingot during its formation.

27. A device as defined by claim 1, including means enabling top-pouring of slag into the mold.

28. A device for manufacturing a hollow metal ingot by electroslag melting from consumable metal electrode means comprising: a cooled mold for retaining molten slag bath; a bottom plate for supporting the hollow ingot as it is being made; a cooled core member having a free upper end mounted for movement within said mold to form the internal cavity of said hollow ingot with its upper end surrounded by said slag bath; means including said electrode means to form a molten metal pool below said molten slag bath; means to provide relative movement at least in the axial direction, between said core member and said bottom plate, in such a manner that at least a portion of the upper end face of said core member is maintained in contact with said molten slag bath during formation of said ingot; an electric power source provided for said device including outlet connections to said mold, said core member, and said bottom plate from one potential point thereof and to said consumable electrode means from the other potential point thereof; and means to axially reciprocate and to reciprocally rotate said core member within said hollow ingot during its formation.

29. A device as defined by claim 28, including: means to maintain said electrode means in contact with said molten metal bath; and means to bottom pour molten slag into said mold to start the melting of said consumable electrode means.

30. A device as defined by claim 29, including means enabling top-pouring of slag into the mold.

31. A device as defined by claim 28, including means to maintain said core member in fixed position and to move said mold and said bottom plate together with said hollow ingot axially downwardly thereover.

32. A device as defined by claim 28, wherein said means to form a molten metal pool includes: said consumable metal electrode means in contact with said molten slag bath, and wherein said device includes means to move said electrode means axially into said molten slag bath during melting and to move said consumable electrode means in the direction of movement of said mold relative to said core member; and means to maintain said core member in fixed axial position.

33. A device as defined by claim 28, wherein means are provided for fluid cooling said mold, said bottom plate and said core member.

34. A device as defined by claim 28, wherein said source of electric power has an A.C. output.

35. A device as defined by claim 28, wherein said source of electric power has a D. C. output.

36. A device as defined by claim 28, including means enabling top-pouring of slag into the mold.

37. A device for electroslag remelting comprising: a mold having a remelting zone defined by the lower portion thereof and adapted to retain a quantity of molten slag therein; a consumable metal electrode in contact with said slag bath; a bottom plate for supporting an ingot formed during melting; a source of electric power connecting said consumable electrode and said bottom plate; means for providing axial movement of said mold during remelting; means for providing axial movement of said consumable electrode during remelting; a cooled core having a free upper end disposed within said mold to form an internal cavity in the ingot being built-up by the remelting of said consumable electrode; a source of electric power connected to said cooled core; and means to provide axial movement of said mold in such a manner that at least a portion of the upper face of said cooled core is constantly in contact with said molten slag bath.

38. A device as defined in claim 37, including means provided to move said consumable electrode axially with respect to said mold during remelting.

39. A device as defined by claim 37, including means enabling top-pouring of slag into the mold.

40. A device for electroslag melting of metal from consumable metal electrode means comprising: a mold for retaining a molten slag bath; means, for introducing molten slag to said mold, located adjacent to the bottom portion of said mold; means including said electrode means for forming a molten metal pool below said molten slag bath; means for moving the mold at least in a direction along its axis during the melting of the metal; a core member having a free upper end and at least a portion thereof positioned within said mold for forming an internal cavity in the ingot produced from the electroslag melting of metal; a bottom plate for supporting said ingot; and means to control the movement of said core member relative to said bottom plate to maintain at least a portion of the upper face of said core member in constant contact with said molten slag bath.

41. A device as defined by claim 40, including means enabling top-pouring of slag into the mold.

42. A device for electroslag melting of metal from consumable metal electrode means to make a hollow ingot comprising: a mold for retaining a molten slag bath; a bottom plate for supporting the ingot produced by said device; means for introducing molten slag to said mold including a slag conducting runner located adjacent to the bottom portion of said mold; means including said electrode means for forming a molten metal pool below said molten slag bath; means for moving said mold and said bottom plate axially relative to each other during melting; a core member having a free upper end and at least a portion of said core member being adaptable for movement within said mold for forming the internal cavity in the hollow ingot; and means to control the movement of said core member relative to said bottom plate so as to maintain at least a portion of the upper face of said core member in constant contact with said molten slag bath.

43. A device as defined by claim 42, including means enabling top-pouring of slag into the mold.

44. A device for electroslag remelting comprising: a mold having a remelting zone defined by the lower portion thereof and adapted to retain a quantity of molten slag therein; a consumable metal electrode in contact with said slag bath; a bottom plate for supporting an ingot formed during melting; a source of electric power connecting said consumable electrode and said bottom plate; means for controlling the axial movement of said mold during remelting; means for maintaining said consumable electrode in fixed axial position with respect to said mold during remelting; a cooled core having a free upper end disposed within said mold to form an internal cavity in the ingot being built-up by the remelting of said consumable electrode; means for moving said cooled core axially with respect to said mold during remelting; a source of electric power connected to said cooled core; and means to control the axial movement of said mold in such a manner that at least a portion of the upper face of said cooled core is constantly in contact with said molten slag bath.

* * * * *

UNITED STATES PATENT OFFICE

CERTIFICATE OF CORRECTION

Patent No. 3,990,500 Dated November 9, 1976

Inventor(s) Boris Evgenievich Paton et al

It is certified that error appears in the above-identified patent and that said Letters Patent are hereby corrected as shown below:

Column 1, line 59, after "making" add --metal--.

Claim 11, line 2, change "of" to --for--.

Claim 28, line 3, after "retaining" add --a--.

Signed and Sealed this

First Day of February 1977

[SEAL]

*Attest:*

RUTH C. MASON
*Attesting Officer*

C. MARSHALL DANN
*Commissioner of Patents and Trademarks*